US010260706B2

(12) United States Patent
Wu

(10) Patent No.: US 10,260,706 B2
(45) Date of Patent: Apr. 16, 2019

(54) LAMP COVER CAPABLE OF SIMULATING MULTIPLE IMAGES

(71) Applicant: Min He, Zhongshan (CN)

(72) Inventor: Mingchun Wu, Zhongshan (CN)

(73) Assignee: Min He, Guangdong (CN)

( * ) Notice: Subject to any disclaimer, the term of this patent is extended or adjusted under 35 U.S.C. 154(b) by 35 days.

(21) Appl. No.: 15/612,519

(22) Filed: Jun. 2, 2017

(65) Prior Publication Data

US 2018/0252385 A1 Sep. 6, 2018

(30) Foreign Application Priority Data

Mar. 2, 2017 (CN) ..... 2017 2 0198062 U

(51) Int. Cl.

| | |
|---|---|
| ***F21V 1/12*** | (2006.01) |
| ***F21V 1/26*** | (2006.01) |
| ***F21V 7/22*** | (2018.01) |
| ***F21V 7/04*** | (2006.01) |
| *F21V 3/04* | (2018.01) |
| *F21W 121/00* | (2006.01) |

(52) U.S. Cl.

CPC ..... *F21V 1/12* (2013.01); *F21V 1/26* (2013.01); *F21V 7/04* (2013.01); *F21V 7/22* (2013.01); *F21V 3/04* (2013.01); *F21V 3/049* (2013.01); *F21W 2121/002* (2013.01)

(58) Field of Classification Search

CPC ..... F21V 1/12; F21V 1/16; F21V 1/17–1/24; F21V 1/20; F21V 1/26; F21V 3/04; F21V 3/049; F21V 7/04; F21V 7/22; F21W 2121/00

See application file for complete search history.

(56) References Cited

U.S. PATENT DOCUMENTS

| | | | | |
|---|---|---|---|---|
| 3,751,319 | A * | 8/1973 | Green | B29C 41/08 156/242 |
| 6,729,747 | B1 * | 5/2004 | Wirayani | F21V 1/12 362/355 |
| 7,029,152 | B1 * | 4/2006 | Kuhl | B60Q 1/26 362/140 |
| 2002/0102508 | A1 * | 8/2002 | LaVanier | F21S 13/12 431/291 |
| 2003/0064337 | A1 * | 4/2003 | Pesu | F21V 1/22 431/291 |
| 2015/0145523 | A1 * | 5/2015 | Harada | G01R 31/42 324/538 |
| 2017/0328536 | A1 * | 11/2017 | Chen | F21V 3/10 |

* cited by examiner

*Primary Examiner* — Zheng Song

(74) *Attorney, Agent, or Firm* — Timothy T. Wang; Ni, Wang & Massand, PLLC

(57) ABSTRACT

A lamp cover capable of simulating multiple images comprises an optically transparent hollow body, an opaque reflector having patterned cutouts and coupled to an inner surface of the body, wherein the opaque reflector is a metal oxide, a matte transparent protective layer formed on the opaque reflector, a polychromatic semitransparent reflector coupled to an outer surface of the body and a glossy transparent protective layer formed on the polychromatic semitransparent reflector.

19 Claims, 4 Drawing Sheets

LAMP COVER CAPABLE OF SIMULATING MULTIPLE IMAGES

BACKGROUND

The instant disclosure pertains to a lighting tool, especially a lamp cover capable of simulating multiple images.

The instant disclosure describes a lamp cover capable of simulating multiple images, comprised of a hollow transparent body. Disposed on the inner surface of the body is a metal oxide coating layer. The metal oxide coating layer is reflective and opaque, and is cut-out with laser printing technology, to form a cut-out pattern. On the outer surface of the body is disposed a polychromatic coating layer. The polychromatic coating layer is reflective and non-opaque or semitransparent. The metal oxide coating layer is coated with a matte transparent environmentally friendly oil protection layer, and the polychromatic coating layer is coated with a glossy transparent oil protection layer. A lamp cover capable of simulating multiple images that adopts the above may form a number of overlapping images of the cut-out pattern on the surface through multiple reflections, so that the pattern seems more realistic. When the lamp is turned on, the decorative pattern has a very high level of emulation on the lamp cover capable of simulating multiple images, so that the lamp cover is more artistic and thus may meet people's needs as a choice for decoration.

Currently, lamp covers are used to cover lamps so that light emission may be controlled. Lamp covers may also utilized to avoid electric shock and protect eyes. There are various types of lamp covers used in daily life.

A lamp such as an LED lamp may be provided with an external lamp cover for the purpose of decoration or dust proofing. The lamp may be separated from the outside environment by the lamp cover. Meanwhile, different lamp covers may have different light transmittance, to meet requirements of users for indoor light. As long as the requirements for light transmittance and dust proofing are met, a lamp cover may also provide for artistic expression, thus, a lamp cover may be decorative. One decoration method may be to paste various types of patterns on the outside of a lamp cover to realize various kinds of light and shadow effects by means of projection while strengthening the ornamental value of the lamp cover. However, a pasted pattern may fall off. Cut-out portions of various shapes within in a lamp cover may also be used for various kinds of light and shadow effects. However, a cut-out may result in the entry of dust or winged insects, which may affect the use of the lamp cover.

Existing lamp covers may be stereotypical in nature and may be constructed of materials such as acrylic or decorated with decorative designs. Consumers may be blasé about such types of lamp covers. Thus, a design with a disruptive structure and shape of a lamp cover that attracts the attention of consumers while meeting basic requirements for a lamp cover is an issued to be dealt with.

SUMMARY

In one embodiment a lamp cover capable of simulating multiple images that comprises at least one of an optically transparent hollow body, an opaque reflector having patterned cutouts and coupled to an inner surface of the body, wherein the opaque reflector is a metal oxide, a matte transparent protective layer formed on the opaque reflector, a polychromatic semitransparent reflector coupled to an outer surface of the body and a glossy transparent protective layer formed on the polychromatic semitransparent reflector.

DETAILED DESCRIPTION OF THE INVENTION

Figure 1:
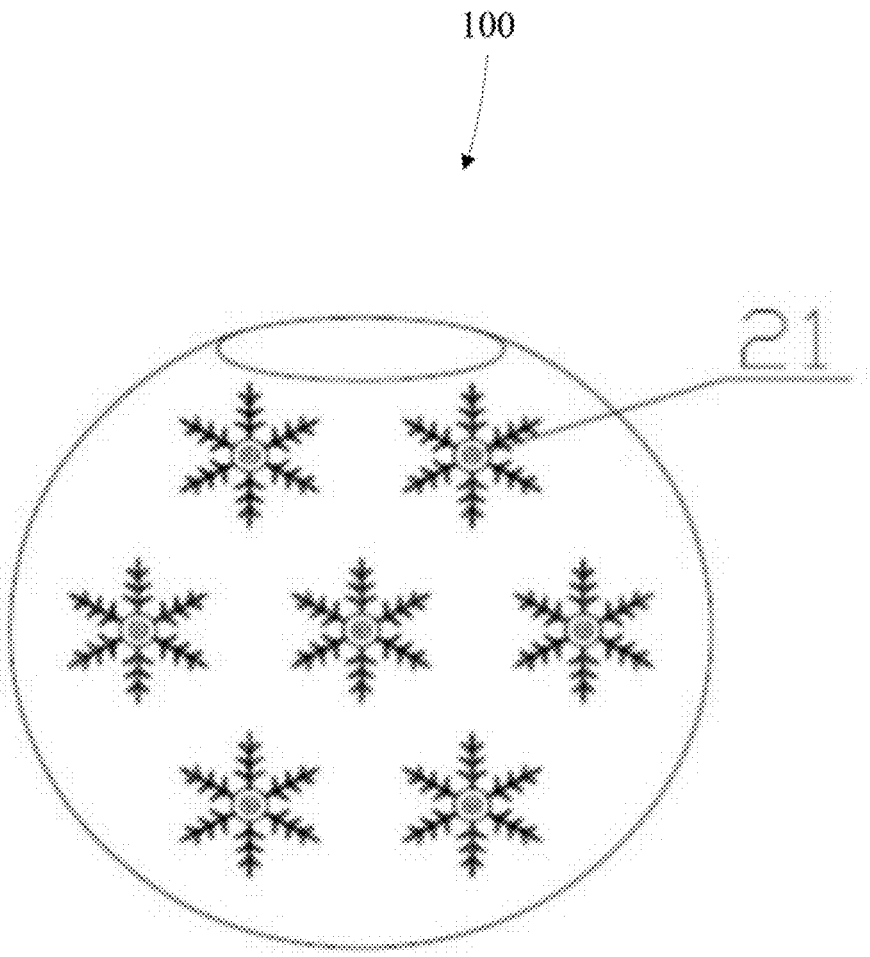
FIG. 1 depicts a first example of the lamp cover in accordance with one embodiment of the disclosure.

It may be readily understood that the components of the present application, as generally described and illustrated in the figures herein, may be arranged and designed in a wide variety of different configurations. Thus, the following detailed description of the examples of a method as represented in the attached figures, is not intended to limit the scope of the application as claimed, but is merely representative of selected examples of the application.

The features, structures, or characteristics of the application described throughout this specification may be combined in a suitable manner in one or more examples. For example, the usage of the phrases example, examples, some examples, or other similar language, throughout this specification refers to the fact that a particular feature, structure, or characteristic described in connection with the example may be comprised in at least one example of the present application. Thus, appearances of the phrases example, examples, in some examples, in other examples, or other similar language, throughout this specification does not necessarily refer to the same group of examples, and the described features, structures, or characteristics may be combined in a suitable manner in one or more examples.

A lamp cover capable of simulating multiple images is provided according to one aspect of the instant disclosure, including a hollow transparent body. On the inner surface of the body, there is a metal oxide coating layer. The metal oxide coating layer is reflective and opaque, and is cut-out with laser printing technology. On the outer surface of the body, there is a polychromatic coating layer. The polychromatic coating layer is reflective and non-opaque or semitransparent. The metal oxide coating layer is coated with an environmental-friendly matte transparent oil protection layer, and the polychromatic coating layer is coated with a glossy transparent oil protection layer. Rays from a light source inside the body exits the cut-out pattern, and are then reflected onto the polychromatic coating layer via the transparent body. In the meanwhile, some rays are reflected onto the metal oxide coating layer by the polychromatic coating layer, while some other rays go through the polychromatic coating layer and are reflected onto the metal oxide coating layer, and are then reflected by the metal oxide coating layer to the polychromatic coating layer. Therefore, rays are reflected between the metal oxide coating layer and the polychromatic coating layer many times, and finally form a number of images of the cut-out pattern on the polychromatic coating layer.

The vacuum coating of the polychromatic layer is a physical method of producing thin film materials. It may be realized by the evaporation of a thin film coated with metal such as aluminum, chromium, tin, stainless steel, etc. on a processed product made of plastics, ceramic, glass, etc. to obtain a polychromatic coating layer that is bright and artistic with many colors. Atoms of materials in a vacuum room are deposited on the surface of the plated object after being separated from a heating source. The deposited atoms may comprise a simple substance or compound film made of crystalline metal, semiconductor, insulator, etc. for coating. Through low pressure, plasma or any other vacuum method for chemical vapor phase deposition, film deposition in vacuum coating may be realized. There are three primary methods of vacuum film coating, that is, evaporation film coating, sputter coating and ion coating.

In some embodiments, the metal oxide coating layer may an Al2O3 coating layer, SiO2 coating layer, TiO2 coating layer, Ti2O3 coating layer, ZrO2 coating layer, LaTiO3 coating layer, BaTiO3 coating layer, SrTiO3 coating layer or PrTiO3 coating layer.

In some embodiments, the polychromatic coating layer may be least an aluminum coating layer, chromium coating layer, tin coating layer or stainless steel coating layer.

In some embodiments, the cut-out may be a cartoon pattern, a geometric pattern or a combination of the above. The pattern may be a plant, an animal, a snowflake, a lightening, a water drop or the like.

In some embodiments, the total area of the cut-out pattern is 10% to 50% of that of the metal oxide coating layer. Thus, the overlapping shadows formed are enriched with a simulation effect.

In some embodiments, the light transmittance of the polychromatic coating layer is 5%-30%. The light transmittance is the percentage of light that exits the polychromatic coating layer to the amount of light that is totally internally reflected. Thus, the overlapping shadows formed are enriched with a simulation effect.

In some embodiments, the thickness of the body is 0.1 to 50 mm, the thickness of the metal oxide coating layer is 2 to 40 nm, and the thickness of the polychromatic coating layer is 2 to 50 mm. Thus, the overlapping shadows have a simulation effect.

In some embodiments, the inner surface and the outer surface of the body have smooth mirror surfaces. Thus, the overlapping shadows have a simulation effect.

A lamp cover capable of simulating multiple images that adopts the foregoing may form a number of overlapping images of the cut-out pattern on the surface through multiple reflections, so that the pattern seems more realistic. When the lamp is turned on, the decorative pattern has a very high level of emulation on the lamp cover capable of simulating multiple images, so that the lamp cover is more artistic and thus may meet people's needs as a choice for decoration.

First Example Embodiment

Figure 2:
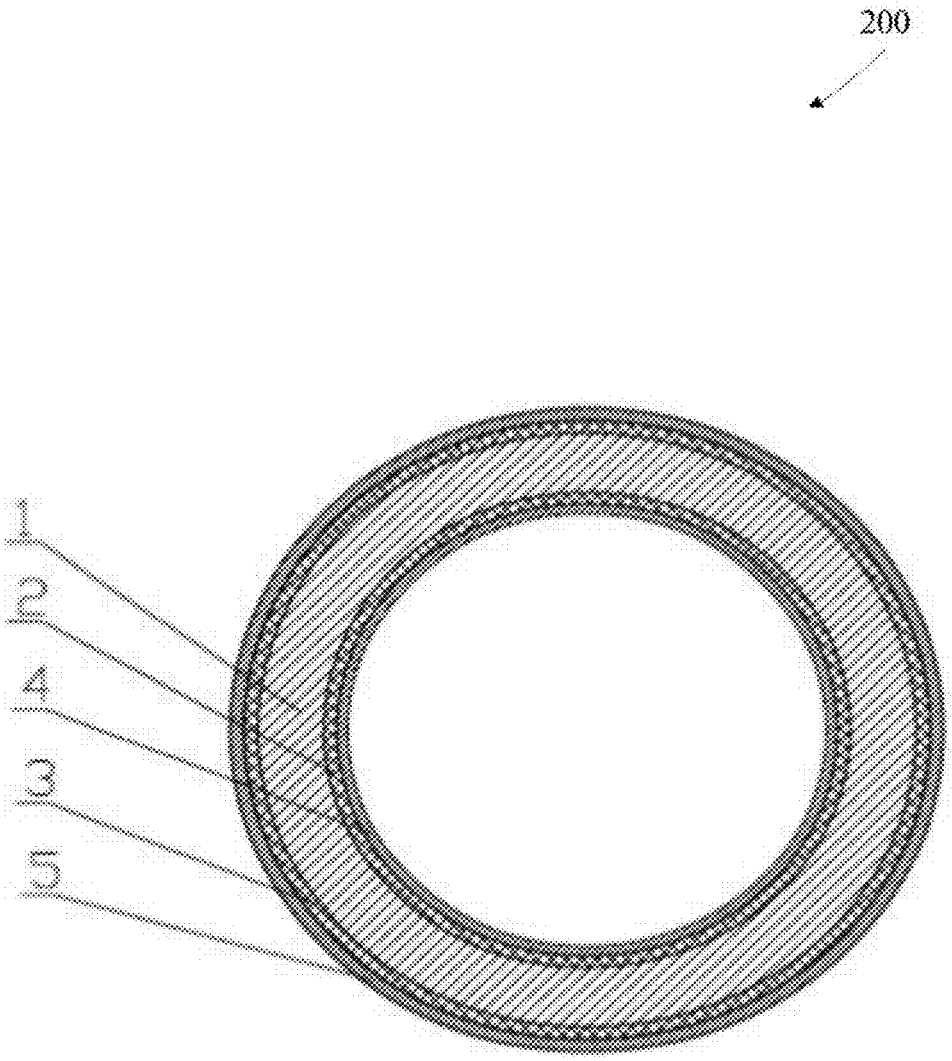
FIG. 2 depicts a cross-section of the lamp cover in accordance with one embodiment of the disclosure.

FIGS. 1 and 2 show a type of lamp cover capable of simulating multiple images according to an embodiment of the present disclosure. As is shown in the figures, the device includes a hollow transparent body 1. The hollow transparent body forms a shell.

The inner surface and the outer surface of body 1 are smooth mirror surfaces. The inner surface of body 1 is provided with metal oxide coating layer 2.

The metal oxide coating layer 2 is reflective and opaque. The metal oxide coating layer 2 may be an Al2O3 coating layer, SiO2 coating layer, TiO2 coating layer, Ti2O3 coating layer, ZrO2 coating layer, LaTiO3 coating layer, BaTiO3 coating layer, SrTiO3 coating layer or PrTiO3 coating layer. The metal oxide coating layer 2 is cut-out with laser printing technology to form the cut-out pattern 21.

In this embodiment, the cut-out pattern 21 is a snowflake pattern. The total area of the cut-out pattern 21 is 10% to 50% of that of the metal oxide coating layer. Thus, the overlapping shadows formed are enriched with a simulation effect.

The outer surface of body 1 is provided with polychromatic coating layer 3. The polychromatic coating layer 3 may be an aluminum coating layer, chromium coating layer, tin coating layer or stainless steel coating layer. The polychromatic coating layer 3 is reflective and non-opaque. The light transmittance of polychromatic coating layer 3 is 5%-30%. The light transmittance may be the percentage of light that goes through the body when it is reflected on the polychromatic coating layer to the amount of light that is reflected.

In this embodiment, metal oxide coating layer 2 is coated with a matte transparent environmentally friendly oil protection layer 4, and the polychromatic coating layer is coated with glossy transparent oil protection layer 5.

Rays from a light source inside body 1 comes out from the cut-out pattern 21, and are then reflected onto polychromatic coating layer 3 via the transparent body 1. The light may be provided at a geometric center of the body. Some rays may be internally reflected between the metal oxide coating and the polychromatic coating layer 3, and some rays exit the polychromatic coating layer 3. Therefore, rays may be internally reflected between metal oxide coating layer 2 and polychromatic coating layer 3 many times, forming a number of images of the cut-out pattern 21 on polychromatic coating layer 3.

In this embodiment, the thickness of the main body is 0.1 to 50 mm, the thickness of the metal oxide coating layer is 2 to 40 nm, and the thickness of the polychromatic coating layer is 2 to 50 mm.

A lamp cover capable of simulating multiple images that adopts the foregoing may form a number of overlapping snowflake images on the surface, so that the snowflake pattern seems more crystal-clear and realistic. When the lamp is turned on, a decorative pattern with crystal-clear snow-flakes that has a very high level of emulation is formed on the lamp cover capable of simulating multiple images, so that the lamp cover is more artistic and thus may meet people's needs as a choice for decoration.

Second Example Embodiment

Figure 3:
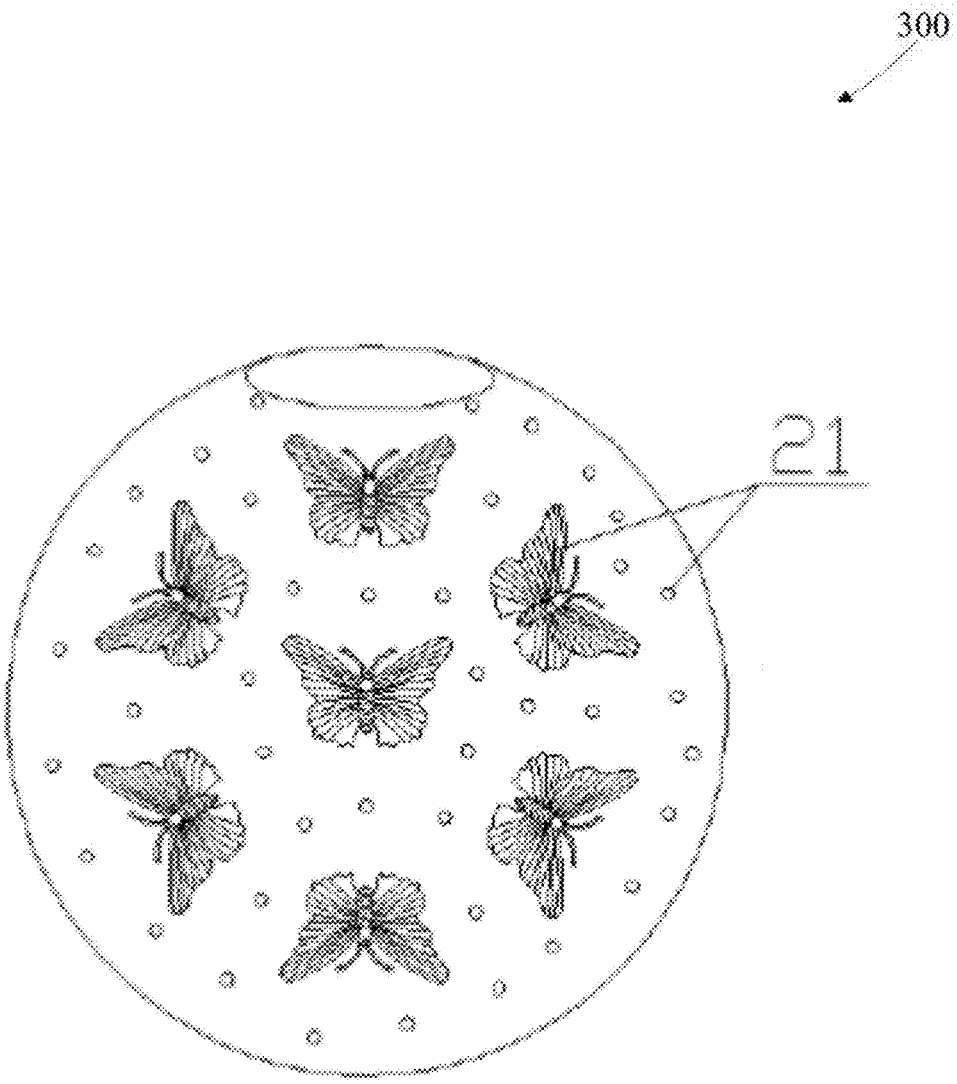
FIG. 3 depicts a second example of the lamp cover in accordance with one embodiment of the disclosure.

FIG. 3 schematically shows a type of lamp cover capable of simulating multiple images according to another embodiment of this disclosure. As is shown in the figure, one difference between this embodiment and the first embodiment is that, the cut-out pattern 21 is formed with the combination of a butterfly pattern and a pattern with dots. Once turned on, the lamp cover can show a dreamlike effect.

Third Example Embodiment

Figure 4:
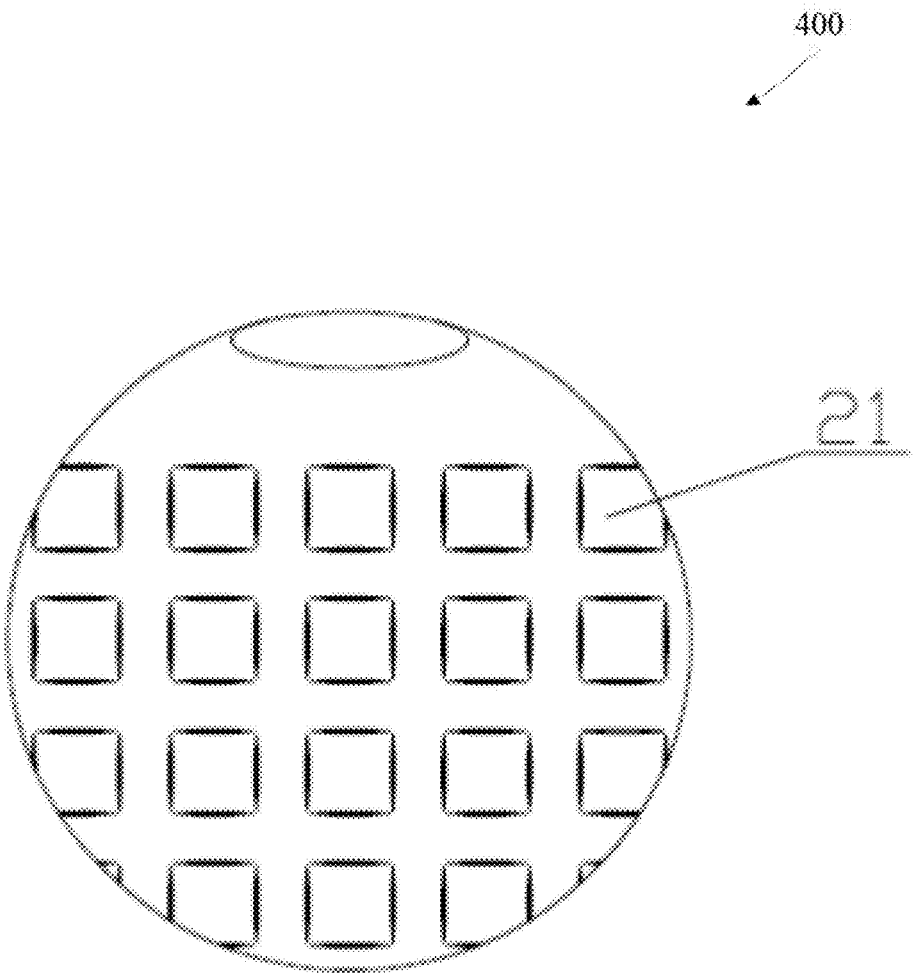
FIG. 4 depicts a third example of the lamp cover in accordance with one embodiment of the disclosure.

FIG. 4 shows a type of lamp cover capable of simulating multiple images according to another embodiment of the instant disclosure. As is shown in the figure, one difference between this embodiment and the first and second embodiments is that, the cut-out pattern is a rectangular geometric figure. Once turned on, the lamp cover may show a crystal effect.

In other embodiments, the cut-out pattern 21 may also be a cartoon pattern, a geometric pattern or a combination of the above. The pattern may be a plant, an animal, a snowflake, a lightening, a water drop or the like.

Although exemplary examples the method of the present disclosure have been illustrated in the accompanied drawings and described in the foregoing detailed description, it will be understood that the application is not limited to the examples disclosed, and is capable of numerous rearrangements, modifications, and substitutions without departing from the spirit or scope of the disclosure as set forth and defined by the following claims.

The above examples are for illustrative purposes and are not intended to limit the scope of the disclosure or the adaptation of the features described herein to particular components. Those skilled in the art will also appreciate that various adaptations and modifications of the above-described preferred examples may be configured without departing from the scope and spirit of the disclosure. Therefore, it is to be understood that, within the scope of the appended claims, the disclosure may be practiced by examples in addition to those specifically described.

What is claimed is:

1. A lamp cover capable of simulating multiple images comprising:

an optically transparent hollow body;

a light source inside the body configured to emit light rays:

an opaque reflector having a plurality of patterned cutouts and coupled to an inner surface of the body, wherein the opaque reflector is a metal oxide;

a matte transparent protective layer formed on the opaque reflector;

a polychromatic semitransparent reflector coupled to an outer surface of the body that reflects light rays that passes through the patterned cutouts a plurality of times between the opaque reflector and the polychromatic semitransparent reflector; and a glossy transparent protective layer formed on the polychromatic semitransparent reflector.

2. The lamp cover of claim 1 wherein the patterned cutouts in the opaque reflector are laser printed.

3. The lamp cover of claim 1 wherein the polychromatic semitransparent reflector provides a single color of reflected light.

4. The lamp cover of claim 1 wherein the polychromatic semitransparent reflector provides multiple colors of reflected light.

5. The lamp cover of claim 1 wherein the matte transparent protective layer is an oil protection layer.

6. The lamp cover of claim 1 wherein the glossy transparent protective layer is an oil protection layer.

7. The lamp cover of claim 1 further comprising a light source disposed approximately at a geometric center of the body.

8. The lamp cover of claim 1 wherein the opaque reflector is comprised of at least one of $AlO_3$, $SiO_2$, $TiO_2$, $Ti_2O_3$, $ZrO_2$, $LaTiO_3$, $BaTiO_3$, $SrTiO_3$ and $PrTiO_3$.

9. The lamp cover of claim 1 wherein the polychromatic semitransparent reflector is comprised of at least one of aluminum, chromium, tin and stainless steel.

10. The lamp cover of claim 1 wherein the patterned cutouts comprise at least one of a cut-out pattern and a geometric pattern.

11. The lamp cover of claim 1 wherein the patterned cutouts comprise at least one of a plant portrayal, an animal portrayal, a snowflake portrayal, a lightening portrayal and a water drop portrayal.

12. The lamp cover of claim 1 wherein the patterned cutouts comprises 10% to 50% of a surface area of the opaque reflector.

13. The lamp cover of claim 1 wherein a light transmittance of the polychromatic semitransparent reflector is 5%-30%.

14. The lamp cover of claim 1 wherein a thickness of the body is 0.1 to 50 mm.

15. The lamp cover of claim 1 wherein a thickness of the opaque reflector is 2 to 40 nm.

16. The lamp cover of claim 1 wherein a thickness of the polychromatic semitransparent reflector is 2 to 50 mm.

17. The lamp cover of claim 1 wherein the inner surface of the body comprises a mirror finish.

18. The lamp cover of claim 1 wherein the outer surface of the body comprises a mirror finish.

19. The lamp cover of claim 1 wherein a portion of light entering the patterned cutouts of the opaque reflector is reflected between the opaque reflector and the polychromatic semitransparent reflector.

* * * * *